US011611140B2

(12) United States Patent
Witts et al.

(10) Patent No.: US 11,611,140 B2
(45) Date of Patent: Mar. 21, 2023

(54) SYSTEMS AND METHODS FOR SENSING A LEVEL OF A VOLUME OF A LIQUID IN A CONTAINER USING ONE OR MORE ANTENNA ELEMENTS

(71) Applicant: AB Elektronik GMBH, Werne (DE)

(72) Inventors: David Witts, Cambridge (GB); Olivier Pajona, Antibes (FR); Markus Frädrich, Werne an der Lippe (DE); Stefan Rühl, Werne an der Lippe (DE); Stephane Proust, Cagnes-sur-Mer (FR); Jaakko Kyllonen, Antibes (FR); Jonathan Hayes, Cambridge (GB)

(73) Assignee: KYOCERA AVX COMPONENTS (WERNE) GMBH, Werne (DE)

( * ) Notice: Subject to any disclaimer, the term of this patent is extended or adjusted under 35 U.S.C. 154(b) by 0 days.

(21) Appl. No.: 16/874,823

(22) Filed: May 15, 2020

(65) Prior Publication Data

US 2020/0388903 A1 Dec. 10, 2020

Related U.S. Application Data

(60) Provisional application No. 62/857,308, filed on Jun. 5, 2019.

(51) Int. Cl.

| | |
|---|---|
| ***H01Q 1/22*** | (2006.01) |
| ***H01Q 9/28*** | (2006.01) |
| ***H01Q 9/30*** | (2006.01) |

(52) U.S. Cl.

CPC ..... *H01Q 1/225* (2013.01); *H01Q 9/285* (2013.01); *H01Q 9/30* (2013.01)

(58) Field of Classification Search

CPC ..... H01Q 1/225; H01Q 1/2233; H01Q 9/285; H01Q 9/30; G01F 23/284

See application file for complete search history.

(56) References Cited

U.S. PATENT DOCUMENTS

| | | | | |
|---|---|---|---|---|
| 5,609,059 | A * | 3/1997 | McEwan | G08B 13/2497 73/290 R |
| 5,832,772 | A | 11/1998 | McEwan | |
| 6,295,881 | B1 | 10/2001 | Stewart et al. | |
| 6,546,795 | B1 * | 4/2003 | Dietz | G01F 23/266 324/657 |
| 6,564,658 | B2 | 5/2003 | Pchelnikov et al. | |
| 8,353,209 | B1 | 1/2013 | Zimmerli | |
| 9,752,917 | B2 * | 9/2017 | Weber | G01F 23/2845 |
| 2007/0000321 | A1 * | 1/2007 | Boudaoud | G01F 23/26 73/304 R |
| 2009/0322545 | A1 * | 12/2009 | Gibson | A61M 5/1684 340/618 |

(Continued)

FOREIGN PATENT DOCUMENTS

| | | |
|---|---|---|
| EP | 3828516 | 6/2021 |
| KR | 20170117629 A * | 10/2017 |

*Primary Examiner* — Seokjin Kim

(74) *Attorney, Agent, or Firm* — Dority & Manning, P.A.

(57) ABSTRACT

A liquid level sensor system can include a container configured to hold a volume of a liquid and a monopole antenna arranged proximate the volume of the liquid. A radiofrequency circuit may be configured to apply a radio frequency signal to the monopole antenna and provide one or more signals indicative of a level of the volume of the liquid within the container based on a radio frequency characteristic of the monopole antenna.

14 Claims, 12 Drawing Sheets

(56) References Cited

U.S. PATENT DOCUMENTS

| | | | | |
|---|---|---|---|---|
| 2013/0291617 | A1 | 11/2013 | Boudaoud et al. | |
| 2013/0325323 | A1* | 12/2013 | Breed | G01C 21/3667 701/420 |
| 2014/0210670 | A1 | 7/2014 | Weber | |
| 2015/0035695 | A1* | 2/2015 | Lin | G01F 23/284 342/124 |
| 2016/0041022 | A1* | 2/2016 | Caplan | G01F 23/26 73/290 V |
| 2016/0265959 | A1 | 9/2016 | Blodt et al. | |

* cited by examiner

SYSTEMS AND METHODS FOR SENSING A LEVEL OF A VOLUME OF A LIQUID IN A CONTAINER USING ONE OR MORE ANTENNA ELEMENTS

PRIORITY CLAIM

The present application claims the benefit of priority of U.S. Provisional Application Ser. No. 62/857,308, filed on Jun. 5, 2019, titled "Systems and Methods for Sensing a Level of a Volume of a Liquid in a Container Using One or More Antenna Elements," which is incorporated herein by reference.

FIELD

The present disclosure relates generally to sensing a level of a volume of a liquid in a container, and more specifically to a system and method for sensing a volume level in a container using one or more antenna elements.

BACKGROUND

Various forms of inductive and capacitive sensors are known for detecting a level of volume of a liquid in a container. Such sensors, however, often require precise, complex components that can be costly to manufacture. Accordingly, an improved sensor would be welcomed in the art.

SUMMARY

Aspects and advantages of embodiments of the present disclosure will be set forth in part in the following description, or may be learned from the description, or may be learned through practice of the embodiments.

One example aspect of the present disclosure is directed to a liquid level sensor system. The system may include a container configured to hold a volume of a liquid and a monopole antenna arranged proximate the volume of the liquid. The system may include a radiofrequency circuit configured to apply a radio frequency signal to the monopole antenna and provide one or more signals indicative of a level of the volume of the liquid within the container based on a radio frequency characteristic of the monopole antenna.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
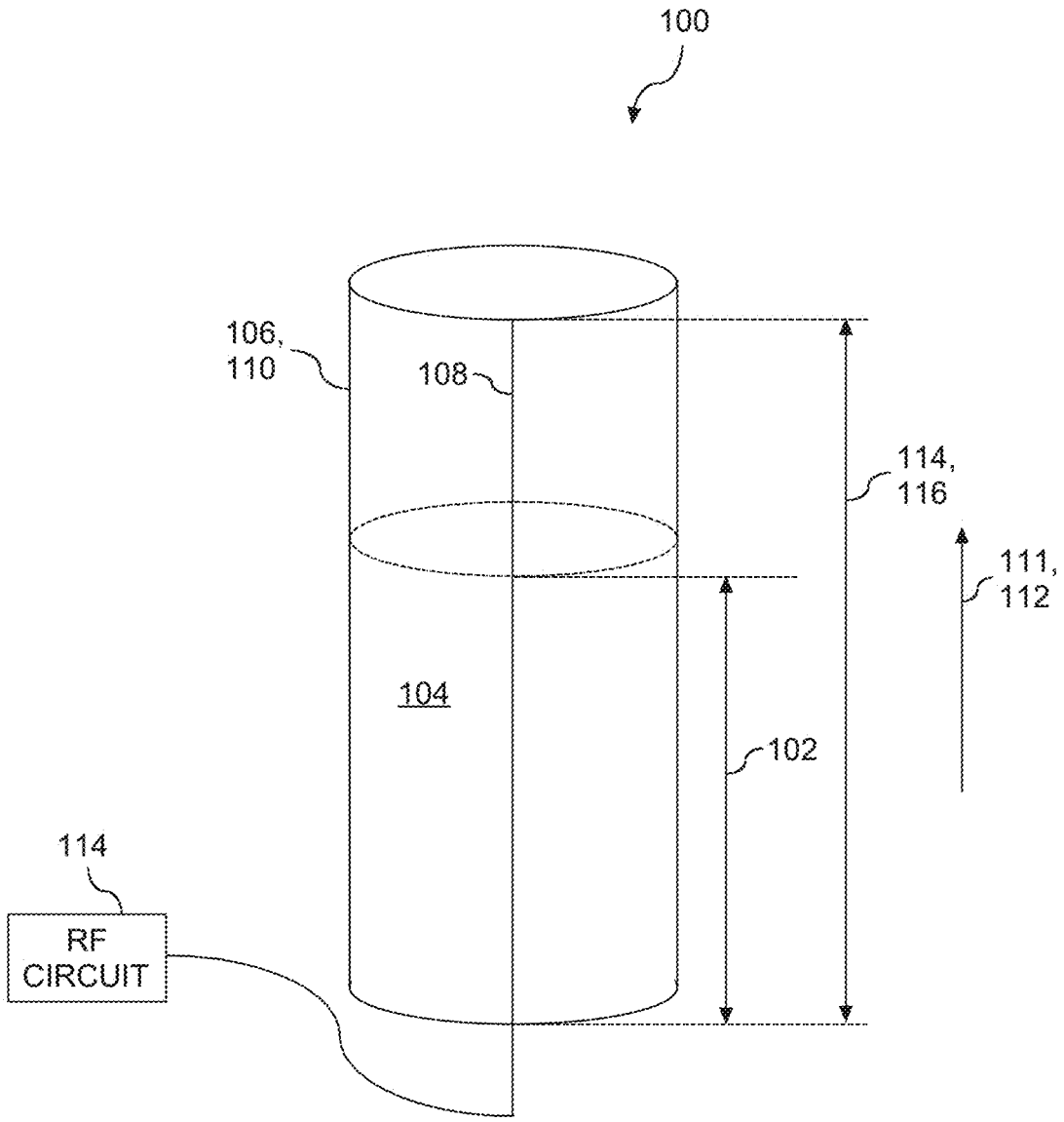
FIG. 1 illustrates an embodiment of a system including a single antenna for sensing a level of a volume of a liquid in a container according to aspects of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to systems and methods for sensing a level of a volume of a liquid in a container. An antenna (e.g., a monopole antenna) can be arranged proximate the volume of the liquid. A radiofrequency circuit can be configured to apply a radio frequency signal to the monopole antenna and provide one or more signals indicative of a level of the volume of the liquid within the container based on a radio frequency characteristic of the antenna. Example radio frequency characteristics include coupling (e.g., between the monopole antenna and an additional monopole antenna), return loss, insertion loss, and/or any other suitable radio frequency characteristics.

In some embodiments, the radio frequency circuit may be configured to apply an additional radio frequency signal to the additional monopole antenna. The radiofrequency circuit (e.g., processing circuitry thereof) configured to calculate a coupling (also referred to as isolation) between the monopole antenna and additional monopole antenna. The radiofrequency circuit can determine the signal(s) that are indicative of the level of the volume of the liquid in the container based on the coupling. For example, the processing circuity may be configured to detect a peak value of the coupling between the monopole antennas. The processing circuity can be configured to calculate the level of the liquid based on the detected peak value. For instance, the radiofrequency circuit can employ a lookup table, a correlating formula (e.g., empirically or theoretically determined), and/or any other suitable means for calculating the liquid level based on the detected peak value.

In other embodiments, return loss may be used. For example, the radiofrequency circuit may provide signals indicative of the level of the volume of the liquid within the container based on a return loss of the first monopole antenna and/or second monopole antenna (if present). For example, the radiofrequency circuit detect the return loss(es) at a test frequency (e.g., 150 MHz). As the volume of liquid changes the return loss at the test frequency may also change. The processing circuity may determine a predicted volume of the liquid in the container by correlating a predicted volume of liquid with the detected return loss at the test frequency (e.g., by a lookup table, correlating formula, etc.).

The present inventors have discovered that using the peak coupling between the monopole antennas to detect the volume of the liquid in the container provides various benefits compared with detecting the return loss of one or more of the monopole antennas. For example, the coupling has been discovered to generally have a single peak value (e.g., under 1 GHz in some embodiments) that correlates well with the volume of liquid. In contrast, the return loss generally does not exhibit such a relationship with the level of the volume of the liquid. Additionally, coupling between a pair of monopole antennas may be less prone to undesirable interference than return loss of an individual monopole antenna. Thus, using coupling may generally be more robust to electromagnetic interference or noise or the presence of nearby conductive objects. As discussed above, however, return loss of a single monopole antenna can still be used to provide signals indicative of the level of the volume of the liquid in the container according to aspects of the present disclosure.

In some embodiments, a liquid level sensor system according to aspects of the present disclosure may include a container configured to hold a volume of a liquid and a monopole antenna arranged proximate the volume of the liquid. The system may include a radiofrequency circuit configured to apply a radio frequency signal to the monopole antenna and provide one or more signals indicative of a level of the volume of the liquid within the container based on a radio frequency characteristic of the monopole antenna.

In some embodiments, the monopole antenna may be coupled to an outer surface of the container.

In some embodiments, the monopole antenna may be arranged less than 5 cm from the volume of the liquid, in some embodiments less than 4 cm, in some embodiments less than 3 cm, in some embodiments less than 2 cm, and in some embodiments less than about 1 cm.

In some embodiments, the monopole antenna may be outside of the volume of the liquid.

In some embodiments, the system may further include an additional monopole antenna arranged parallel with the monopole antenna. The additional monopole antenna may be located opposite the monopole antenna with respect to the container. The monopole antenna may have a length that is about equal to a length of the additional monopole antenna.

In some embodiments, the monopole antenna may have a length in a first direction, and the additional monopole antenna has a second length in the first direction. A ratio of the first length to the second length may range from about 0.5 to about 2, in some embodiments from about 0.6 to about 1.7, in some embodiments from about 0.7 to about 1.5, in some embodiments from about 0.8 to about 1.2, in some embodiments from about 0.9 to about 1.1, in some embodiments from about 0.95 to about 1.05, and in some embodiments from about 0.98 to about 1.02.

In some embodiments, the radiofrequency circuit may be configured to apply an additional radio frequency signal to the additional monopole antenna.

In some embodiments, the radiofrequency circuit may be configured to calculate a coupling between the monopole antenna and additional monopole antenna. The may be configured determine the signal(s) indicative of the level of the volume of the liquid in the container based on the coupling.

In some embodiments, the radiofrequency circuit may be configured to calculate a peak coupling value between the monopole antenna and additional monopole antenna at a test frequency, and wherein the one or more signals indicative of the level of the volume of the liquid are positively correlated with the coupling at the test frequency.

In some embodiments, the radiofrequency circuit may be configured to apply an additional radio frequency signal to the additional monopole antenna; calculate a peak coupling frequency between the monopole antenna and additional monopole antenna; and determine the one or more signals indicative of the level of the volume of the liquid provided by the radiofrequency circuit based on the peak coupling frequency.

In some embodiments, the radiofrequency circuit may be configured to calculate a return loss of the radio frequency signal. The signal(s) indicative of the level of the volume of the liquid within the container may be based on the return loss.

In some embodiments, the container may include plastic. It should be understood, however, that the container may generally include a variety of suitable materials, such as ceramic, glass, metal, or polymeric materials (e.g., resins). In some embodiments, the container may generally be non-conductive to prevent interference with the radio frequency signals of the antenna(s).

In some embodiments, the monopole antenna may be elongated in a direction that forms an angle with a vertical direction. The angle may range from 0 degrees to about 70 degrees. For instance, in some embodiments the monopole antenna may be aligned with the vertical direction (e.g., the angle may be 0 degrees).

Another example aspect of the present disclosure is directed to a vehicle sensor system for detecting a level of a liquid. The vehicle sensor system may include a container configured to hold a volume of the liquid and a monopole antenna arranged proximate the volume of the liquid. The vehicle sensor system may include radiofrequency circuit configured to apply a radio frequency signal to the monopole antenna and provide one or more signals indicative of the level of the volume of liquid within the container.

In some embodiments, the liquid may include at least one of oil, coolant fluid, power steering fluid, brake fluid, or windshield wiper fluid.

In some embodiments, the vehicle sensor system may further include an additional monopole antenna arranged parallel with the monopole antenna.

In some embodiments, the additional monopole antenna may be located opposite the monopole antenna with respect to the container.

In some embodiments, the monopole antenna may have a length that is about equal to a length of the additional monopole antenna.

In some embodiments, the monopole antenna may have a first length in a first direction and the additional monopole antenna has a second length in the first direction. A ratio of the first length to the second may range from about 0.5 to about 2, in some embodiments from about 0.6 to about 1.7, in some embodiments from about 0.7 to about 1.5, in some embodiments from about 0.8 to about 1.2, in some embodiments from about 0.9 to about 1.1, in some embodiments from about 0.95 to about 1.05, and in some embodiments from about 0.98 to about 1.02.

In some embodiments, the radiofrequency circuit may be configured to apply an additional radio frequency signal to the additional monopole antenna and calculate coupling between the monopole antenna and additional monopole antenna. The radiofrequency circuit may be configured to determine the signal(s) provided by the radiofrequency circuit based on the coupling.

In some embodiments, the radiofrequency circuit may be configured to calculate a peak coupling value between the monopole antenna and additional monopole antenna at a test frequency. The signal(s) provided by the radiofrequency circuit may be positively correlated with the coupling at the test frequency.

In some embodiments, the test frequency ranges from about 50 MHz to about 5 GHz, in some embodiments from about 70 MHz to about 4 GHz, in some embodiments from about 80 MHz to about 3 GHz, and in some embodiments from about 100 MHz to about 2 GHz. The test frequency may be selected based various characteristics of the system, such as the size of the container, the type of material of the container, the type of liquid of in the container or any other suitable characteristics that may affect the radiofrequency characteristics of the antennas.

In some embodiments, the radiofrequency circuit may be further configured to apply an additional radio frequency signal to the additional monopole antenna; calculate a peak coupling frequency between the monopole and additional monopole antenna; and determine the signal(s) provided by the radiofrequency circuit based on the peak coupling frequency.

In some embodiments, the container may include plastic.

In some embodiments, the monopole antenna may be elongated in a direction that forms an angle with a vertical direction. The angle may range from 0 degrees to about 70 degrees.

Another example aspect of the present disclosure is directed to method for sensing a level of a volume of a liquid in a container. The method may include applying a first radio frequency signal to a first monopole antenna arranged proximate the volume of the liquid; applying a second radio frequency signal to a second monopole antenna arranged proximate the volume of the liquid; and providing one or more signals indicative of the level of the volume of the liquid within the container based on a coupling between the first monopole antenna and the second monopole antenna.

FIG. 1 illustrates an embodiment of a system 100 for sensing a level 102 of a volume of a liquid 104 in a container 106. The container 106 may be configured to hold the liquid 104. The system 100 may include a monopole antenna 108 arranged proximate an outer surface 110 of the container 106. As used herein, "proximate" can refer to locations of the monopole antenna 108 that are sufficiently close to the liquid 104 such that the level 102 of the volume of liquid 104 in the container 106 affects a radio frequency characteristic of the monopole antenna 108 to a measurable degree. For example, the monopole antenna 108 may be coupled to an outer surface 110 of the container 106. For instance, the monopole antenna 108 may be arranged less than 5 cm from the volume of the liquid 104. In some embodiments, the monopole antenna 108 may be located outside of the volume of the liquid 104. In other embodiments, however, at least a portion of the monopole antenna 108 may contact or be submerged within the volume of the liquid 104.

The monopole antenna 108 may be elongated in a direction 111 that forms an angle with a vertical direction 112 that ranges from 0 degrees to about 70 degrees. When used herein with respect to a numerical value, "about" may refer to plus or minus 10% of the numerical value. In this example, the angle may be 0 degrees, such that the monopole antenna 106 is elongated in the vertical direction 112. The monopole antenna 106 may have a length 114 in the direction 111 that is about equal to a length 116 of the container.

The system 100 a radio frequency circuit 114 that is configured to apply a radio frequency signal to the monopole antenna 108 and provide one or more signals indicative of the level 102 of the volume of the liquid 104 within the container 106 based on a radio frequency characteristic of the monopole antenna 108.

Figure 2:
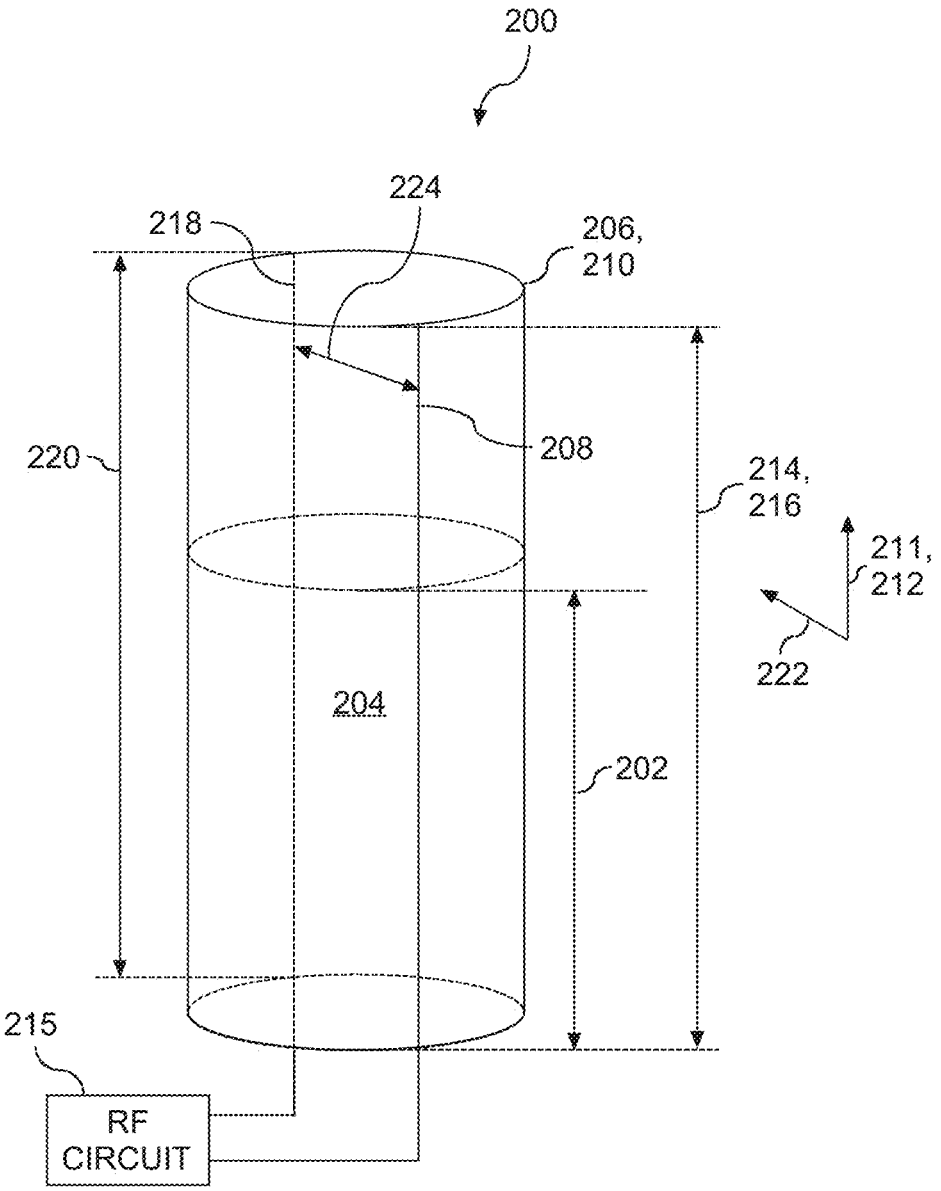
FIG. 2 illustrates another embodiment of a system including a pair of antennas for sensing a level of a volume of a liquid in a container according to aspects of the present disclosure.

FIG. 2 illustrates an embodiment of a system 200 for sensing a level 202 of a volume of a liquid 204 in a container 206. The container 206 may be configured to hold the liquid 204. The system 200 may include a first monopole antenna 208 arranged proximate an outer surface 210 of the container 206. As used herein, "proximate" can refer to locations of the first monopole antenna 208 that are sufficiently close to the liquid 204 such that the level 202 of the volume of liquid 204 in the container 206 affects a radio frequency characteristic of the first monopole antenna 208 to a measurable degree. For example, the first monopole antenna 208 may be coupled to an outer surface 210 of the container 206. The first monopole antenna 208 may be arranged less than 5 cm from the volume of the liquid 204. In some embodiments, the monopole antenna 208 may be located outside of the volume of the liquid 204. In other embodiments, however, at least a portion of the first monopole antenna 208 may contact or be submerged within the volume of the liquid 204.

The first monopole antenna 208 may be elongated in a first direction 211 that forms an angle with a vertical direction 212 that ranges from 0 degrees to about 70 degrees. For instance, in this example, the angle may be 0 degrees, such that the first monopole antenna 208 is elongated in the vertical direction 212. The first monopole antenna 208 may have a first length 214 in the first direction 211 that is about equal to a length 216 of the container 206.

The system 200 may include a second, additional monopole antenna 218 arranged parallel with the first monopole antenna 208. For example, the second, additional monopole antenna 218 may be located opposite the first monopole antenna 208 with respect to the container 206. For example, the container 206 may have a generally circular cross section, and the antennas 208, 218 may be located opposite each other with respect to the generally circular cross section of the container 206. The second, additional monopole antenna 218 may be proximate an outer surface 210 of the container 206 such that the level 202 of the volume of liquid 204 in the container 206 affects a radio frequency characteristic of the second monopole antenna 218 to a measurable degree. For example, the second monopole antenna 218 may be coupled to the outer surface 210 of the container 206. For instance, the second monopole antenna 218 may be arranged less than 5 cm from the volume of the liquid 204. In some embodiments, the second monopole antenna 218 may be located outside of the volume of the liquid 204. In other embodiments, however, at least a portion of the second monopole antenna 218 may contact or be submerged within the volume of the liquid 204.

In some embodiments, the first length 214 of the first monopole antenna. 208 may have a second length 220 that is about equal to the first length 214 of the second additional monopole antenna 208. For instance, a ratio of the first length 214 to the second length 220 may range from about 0.5 to about 2, in some embodiments from about 0.6 to about 1.8, in some embodiments from about 0.7 to about 1.5, in some embodiments from about 0.8 to about 1.2, and in some embodiments from about 0.9, to about 1.1, e.g., about 1.

The first monopole antenna 208 may be spaced apart from the second monopole antenna 218 in a second direction 222 that is perpendicular to the first direction 211 by a spacing distance 224. A ratio of the first length 214 of the first monopole antenna 208 to the spacing distance 224 may range from about 0.5 to about 2.

The system 200 may include a radio frequency circuit 215 that is configured to apply a radio frequency signal to the first monopole antenna 208 and/or the second monopole antenna 218. The radio frequency circuit 215 may be configured to apply an additional radio frequency signal to the second monopole antenna 218. The radio frequency circuit 215 may include processing circuitry that is configured to calculate a coupling between the first monopole antenna 208 and the second monopole antenna 218.

The radiofrequency circuit 215 processing circuitry thereof) may be configured to determine signal(s) indicative of the level 202 of the volume of liquid 204 in the container 206 based on the coupling. For example, the radio frequency circuit 215 may be configured to calculate a peak coupling value between the first monopole antenna 208 and the second monopole antenna 218 at a test frequency. The signal(s) indicative of the level of the volume of the liquid may be positively correlated with the coupling at the test frequency. As another example, the radio frequency circuit 215 may be configured to calculate a peak coupling (minimum isolation) frequency between the first monopole antenna 208 and the second monopole antenna 218. The radio frequency circuit 215 may be configured to determine the signal(s) indicative of the level 202 of the volume of the liquid 204 provided by the radiofrequency circuit 215 based on the peak coupling (minimum isolation) frequency.

Figure 3:
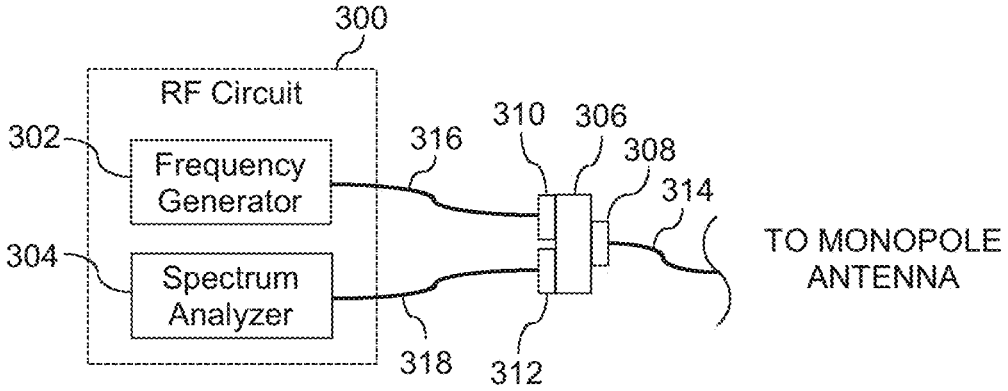
FIG. 3 illustrates an embodiment of a radio frequency circuit according to aspects of the present disclosure.

FIG. 3 illustrates an embodiment of a radio frequency circuit 300 according to aspects of the present disclosure. The radio frequency circuit 300 may correspond with the radio frequency circuit 215 of FIG. 2. The radio frequency circuit 300 may include a radio frequency generator 302 electrically coupled with the monopole antenna (e.g., the first monopole antenna or second monopole antenna). The radio frequency circuit 300 may be configured to apply the radio frequency signal to the monopole antenna. The radio frequency generator 302 may be configured to apply the radio frequency signal to the monopole antenna. The radio frequency signal may be selected to have a variety of suitable attributes, such as frequency, amplitude, etc. For example, the radio frequency signal may include a fixed amplitude sinusoidal signal. The fixed amplitude sinusoidal signal may have a frequency that ranges from about 50 MHz to about 2 GHz.

The characteristics of the radio frequency signal (e.g., amplitude, frequency, etc.) applied by the radio frequency generator 302 may be selected based on characteristics of the system. Example characteristics include size or resonance frequencies of the monopole antenna(s), properties of the container (e.g., material, size, dimensions, etc.).

The radiofrequency circuit 300 may include a spectrum analyzer 304 that is electrically coupled with the monopole antenna and is configured to detect the radio frequency signal reflected by the monopole antenna.

The radiofrequency circuit 300 may be coupled with a splitter 306. The splitter 306 may have a first port 308, a second port 310, and a third port 312. The first port 308 of the splitter 306 may be connected to the monopole antenna (e.g., by a first cable 314). The second port 310 of the splitter 306 may be connected to the frequency generator 302 (e.g., by a second cable 316). The third port 312 may be connected to the spectrum analyzer 304 (e.g., by a third cable 318) such that each of the frequency generator 302 and spectrum analyzer 304 are effectively electrically coupled with the monopole antenna at the same location.

Figure 4:
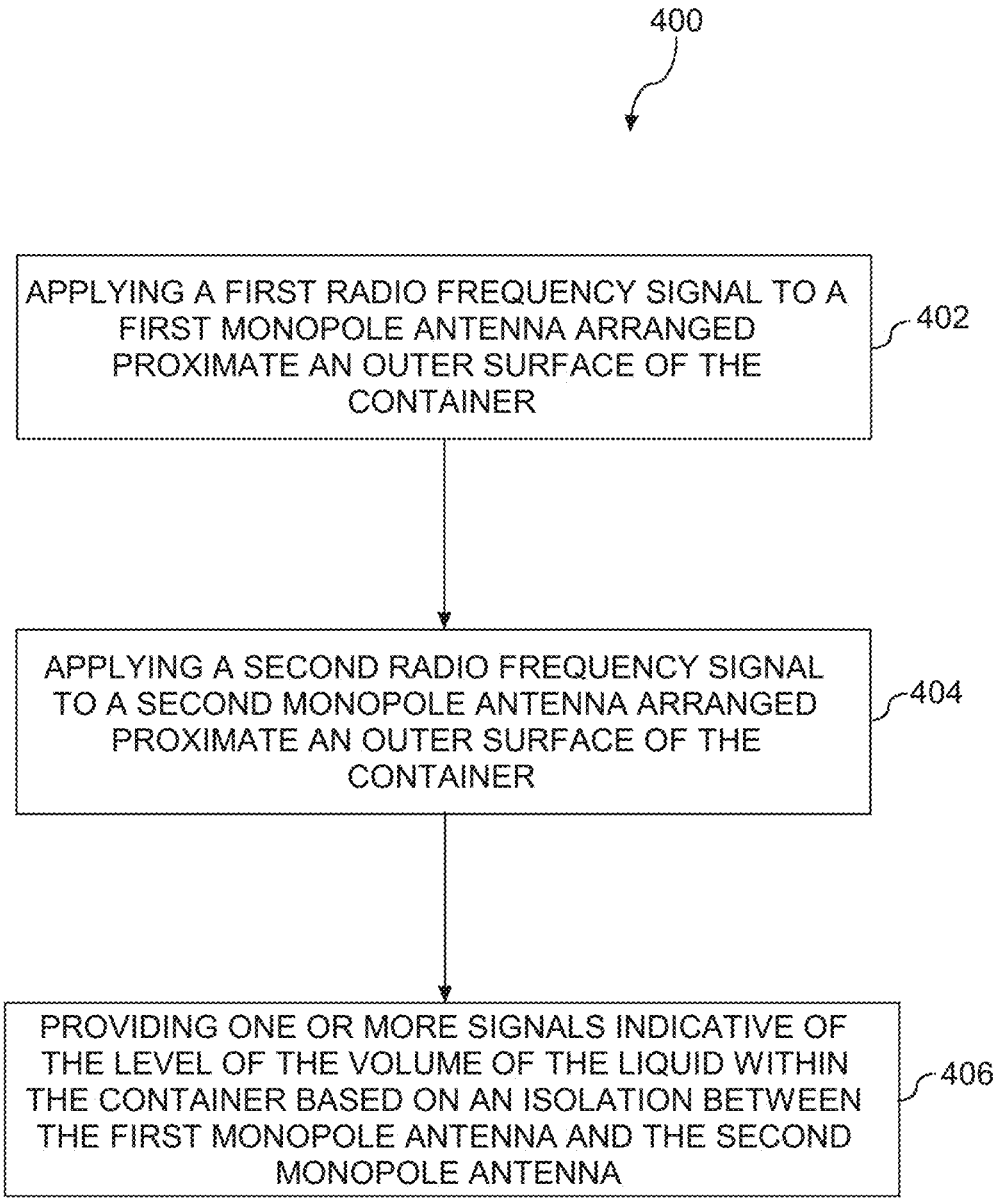
FIG. 4 illustrates a flow diagram of an embodiment of a method for sensing a level of a volume of a liquid in a container according to aspects of the present disclosure.

FIG. 4 illustrates a flow diagram of an embodiment of a method 400 for sensing a level of a volume of a liquid in a container according to aspects of the present disclosure. Although FIG. 4 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure. Moreover, the method 400 may be described herein with reference to the systems 100, 200 described above with reference to FIGS. 1 through 3. However, it should be appreciated that the disclosed method 400 may be used for sensing a level of a volume of a liquid in a container having any suitable configuration.

The method 400 may include, at (402), applying a first radio frequency signal to a first monopole antenna arranged proximate the volume of the liquid for example as described above with reference to FIGS. 1 through 3.

The method 400 may include, at (404), applying a second radio frequency signal to a second monopole antenna arranged proximate the volume of the liquid, for example as described above with reference to FIGS. 2 and 3.

The method 400 may include, at (406), providing one or more signals indicative of the level of the volume of the liquid within the container based on a coupling between the first monopole antenna and the second monopole antenna, for example as described above with reference to FIGS. 2 and 3.

EXAMPLES

Figure 5:
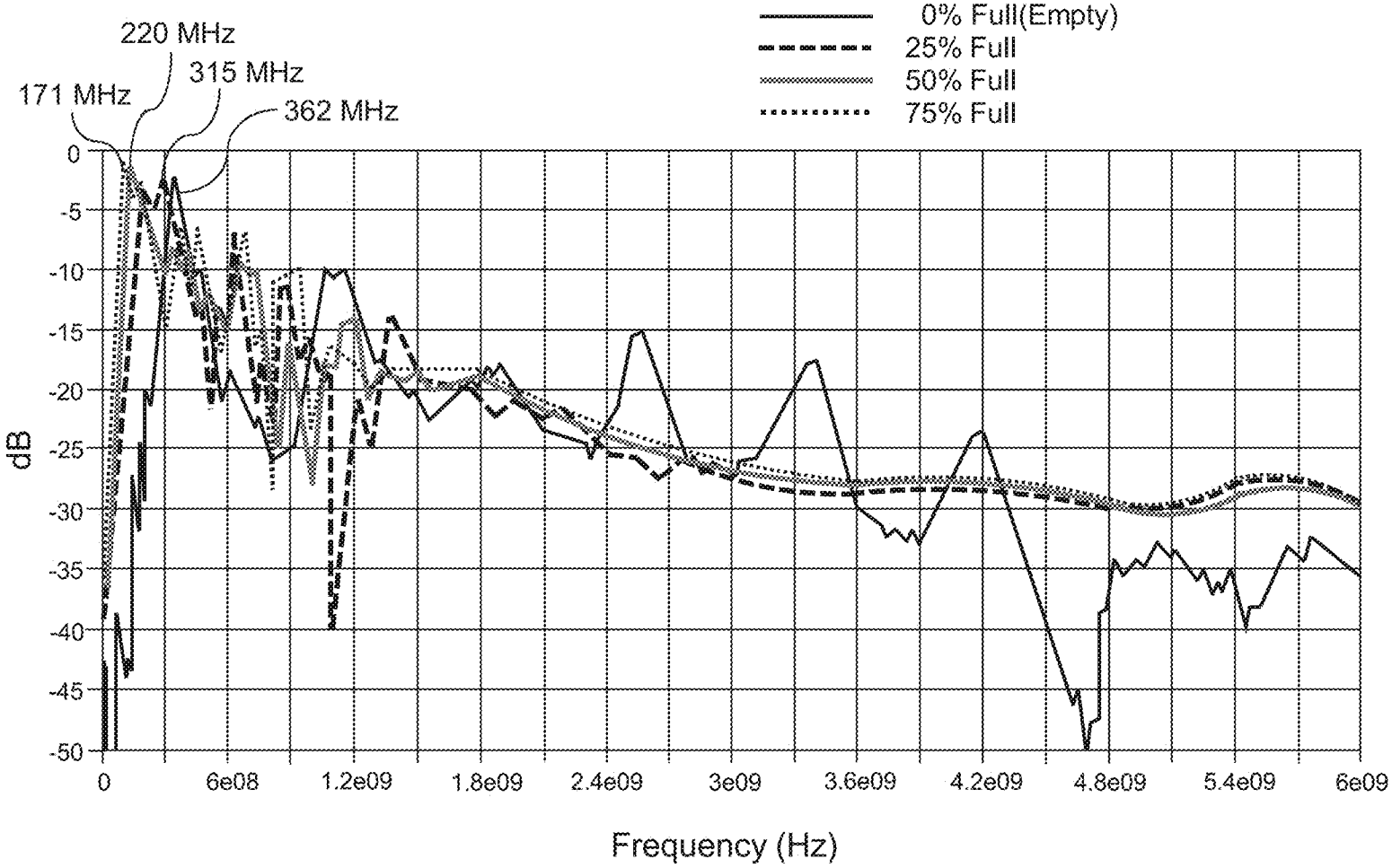
FIG. 5 illustrates coupling for a container containing various levels of liquid according to aspects of the present disclosure.

A system for detecting a level of a liquid similar to the system 200 of FIG. 2 was fabricated and tested. The fabricated system included a pair of monopole antennas 208, 218 as described above with reference to FIG. 2. FIG. 5 illustrates coupling (also referred to as isolation) between the monopole antennas with the container containing various levels of liquid. More specifically, the coupling between the monopole antennas was measured with the container 0% full (empty), 25% full, 50% full, and 75% full. The following table lists frequency values at the respective peaks of the coupling values.

| Percent Full | Frequency (MHz) | Coupling (dB) |
|---|---|---|
| 0 | 362 | −2.331 |
| 25 | 315 | −2.81 |
| 50 | 220 | −1.14 |
| 75 | 171 | −1.271 |

Figure 6:
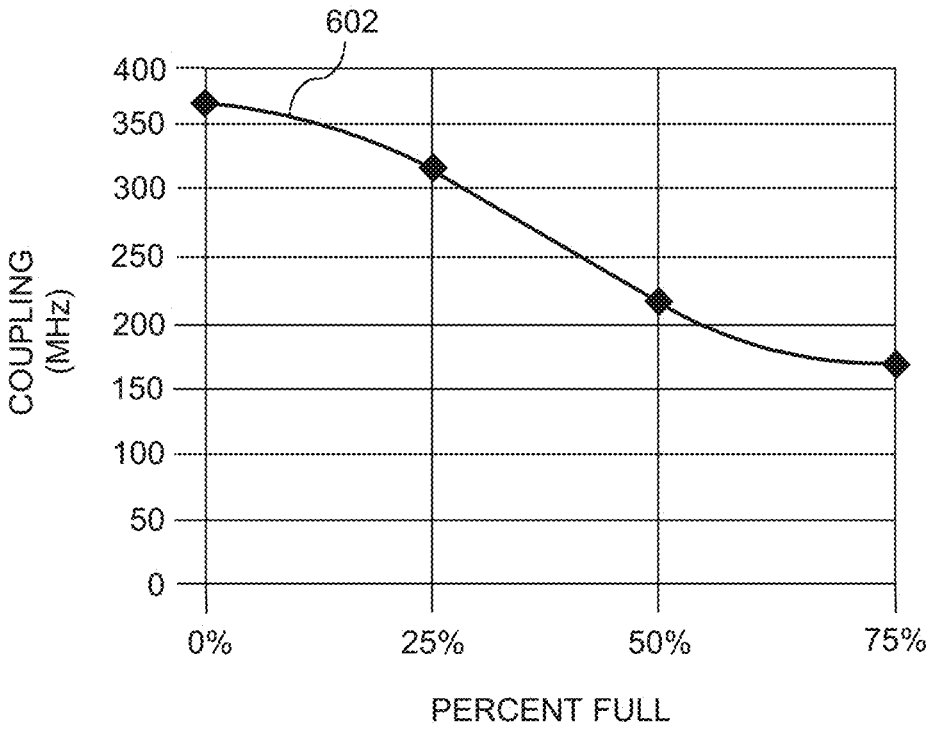
FIG. 6 is a plot of frequencies of respective peak coupling at various levels of liquid for the system of FIG. 2 according to aspects of the present disclosure.
Figure 7A:
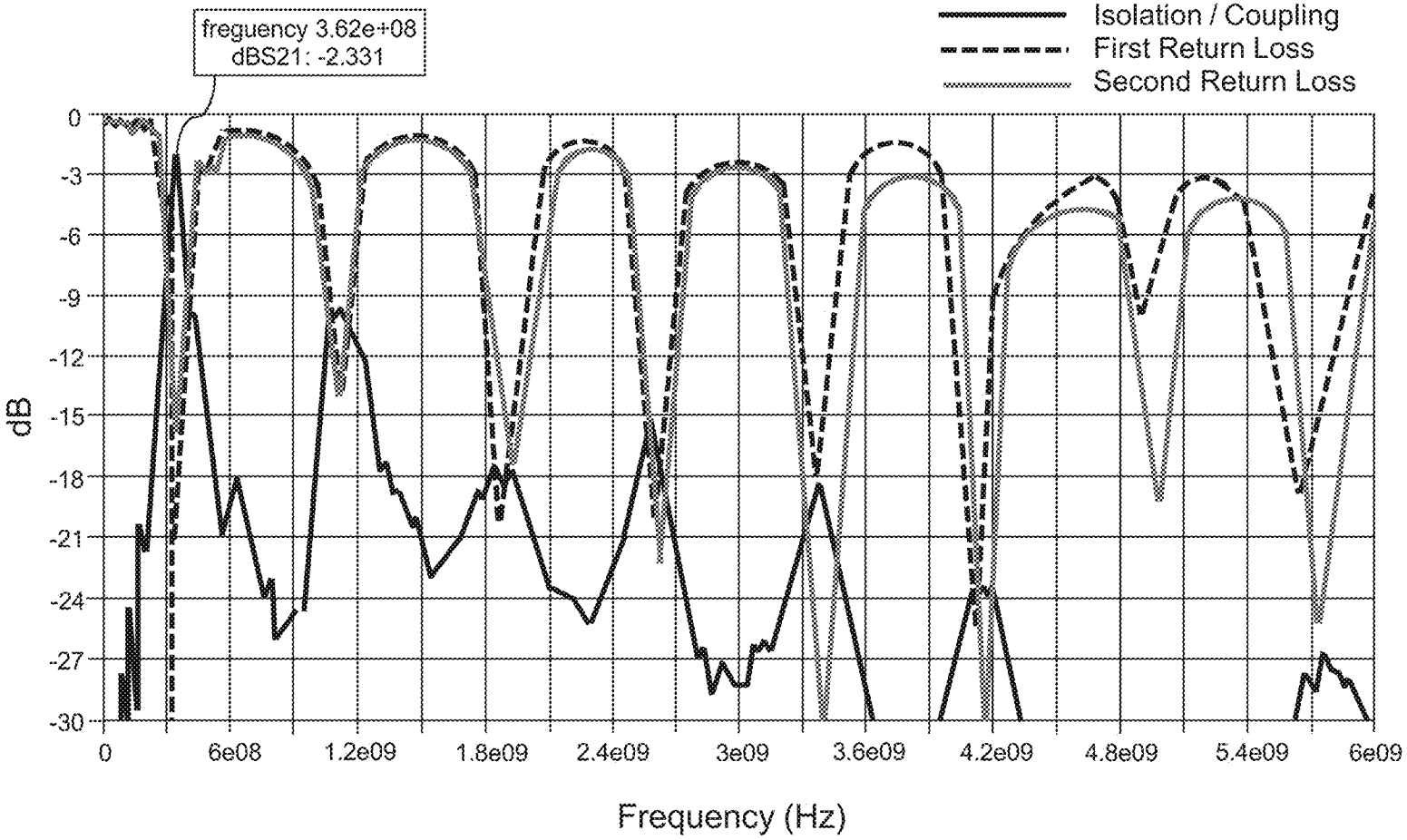
FIG. 7A illustrates an isolation/coupling response between a first monopole antenna and a second monopole antenna, a first return loss for the first monopole antenna, and a second return loss for the second monopole antenna for the system of FIG. 2 in an empty state according to aspects of the present disclosure.
Figure 7B:
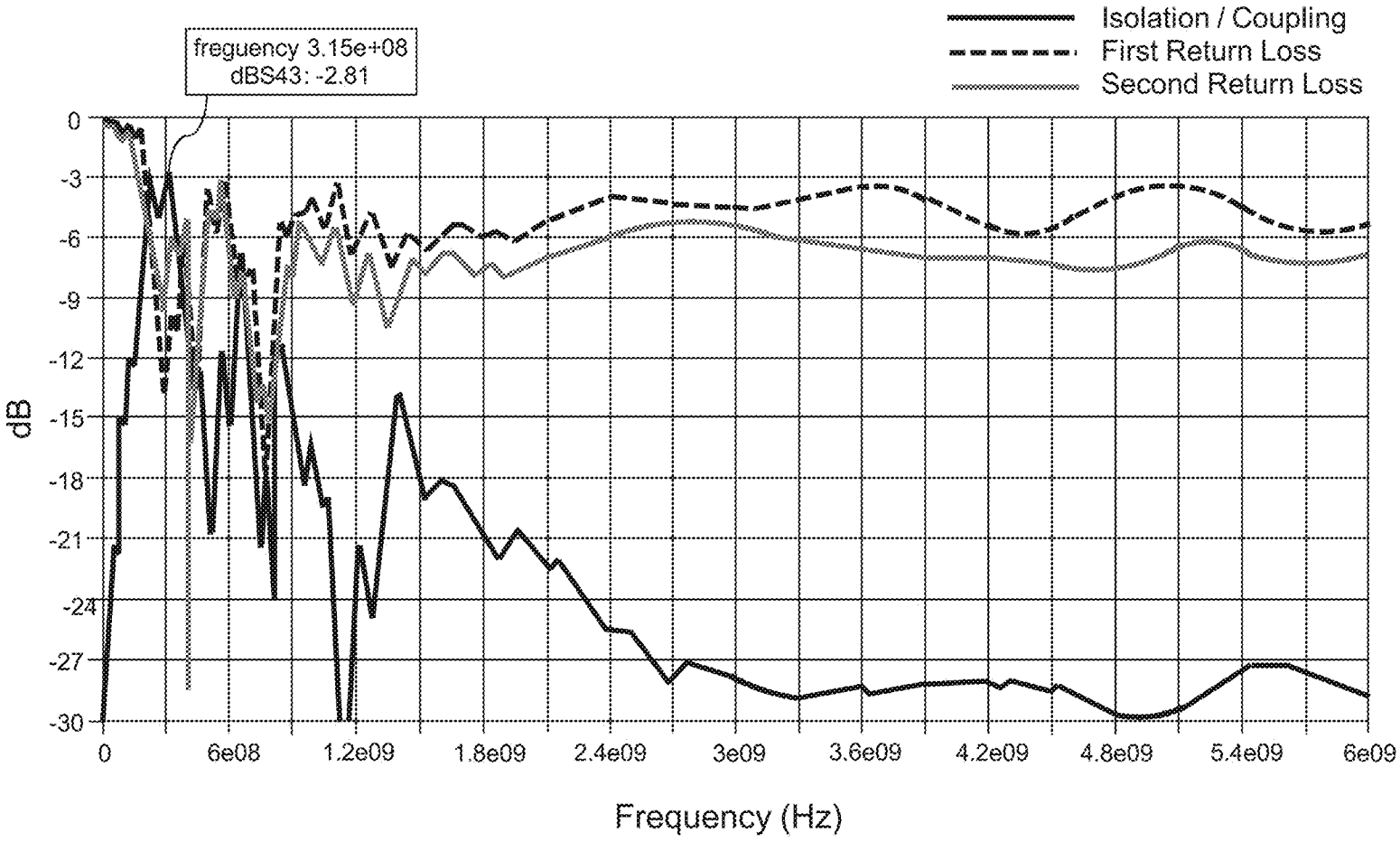
FIG. 7B illustrates an isolation/coupling response between a first monopole antenna and a second monopole antenna, a first return loss for the first monopole antenna, and a second return loss for the second monopole antenna for the system of FIG. 2 when 25% full, according to aspects of the present disclosure.
Figure 7C:
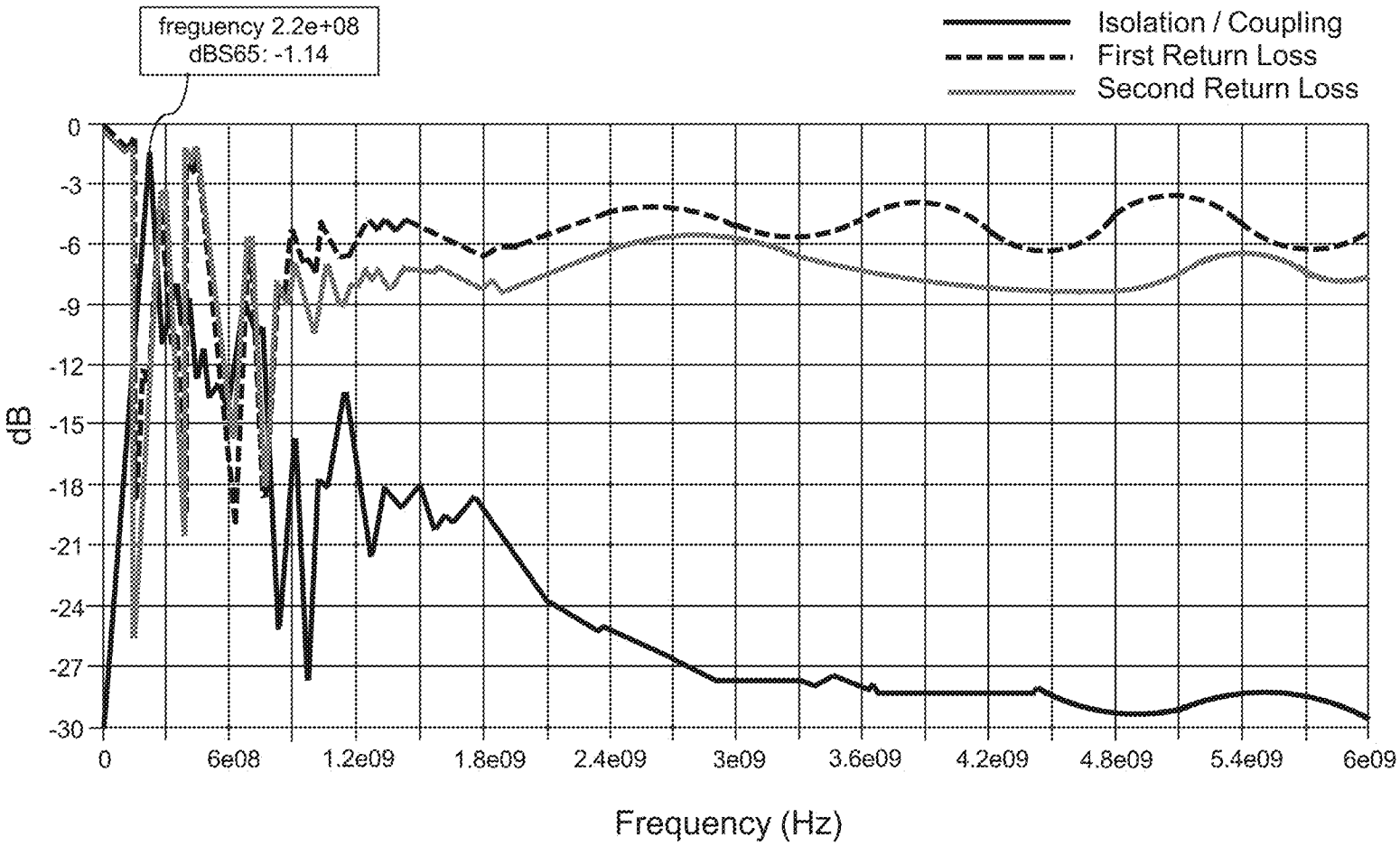
FIG. 7C illustrates an isolation/coupling response between a first monopole antenna and a second monopole antenna, a first return loss for the first monopole antenna, and a second return loss for the second monopole antenna for the system of FIG. 2 when 50% full, according to aspects of the present disclosure.
Figure 7D:
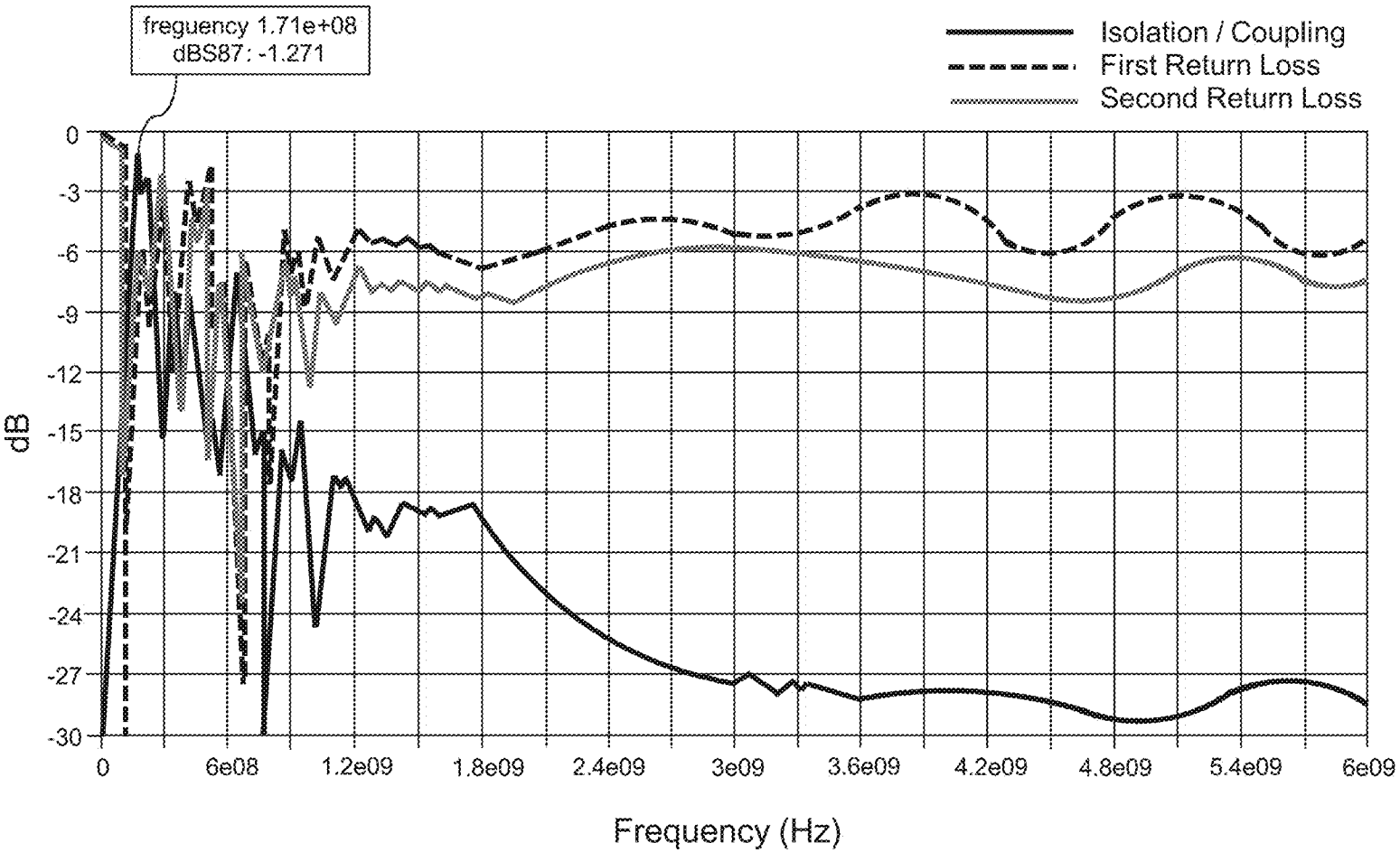
FIG. 7D illustrates an isolation/coupling response between a first monopole antenna and a second monopole antenna, a first return loss for the first monopole antenna, and a second return loss for the second monopole antenna for the system of FIG. 2 when 100% full, according to aspects of the present disclosure.

FIG. 6 plots the frequencies values at the respective peaks against the level of liquid in the container in this example. As shown in FIG. 6 by a trend line 602, a determinable relationship exists between the frequency and the level of the liquid in the container. In this example, the relationship was approximated by the following polynomial relationship, in which L represents the level of the volume of liquid (percent full), and F represents the frequency of the peak coupling between the pair of monopole antennas:

$$L=-2E-05(F)^3+0.0151(F)^2-4.2185(F)+450.65$$

Thus, the level of the container can be estimated based on the detected peak coupling frequency. The radiofrequency circuit (e.g., processing circuitry thereof) may be configured to generate the signals indicative of the level of the liquid using an equation like the one above, may employ a lookup table, or may use any other suitable method to generate the signals based on the detected peak coupling frequency.

FIGS. 7A through 7D illustrate plots of a first return loss for the first monopole antenna, a second return loss for the second monopole antenna, and an coupling between the monopole antennas at each level of container volume listed in Table 5. More specifically, the following table shows which figure corresponds with each level:

| FIG. | Percent Full |
|---|---|
| 7A | 0 |
| 7B | 25 |
| 7C | 50 |
| 7D | 75 |

Figure 8A:
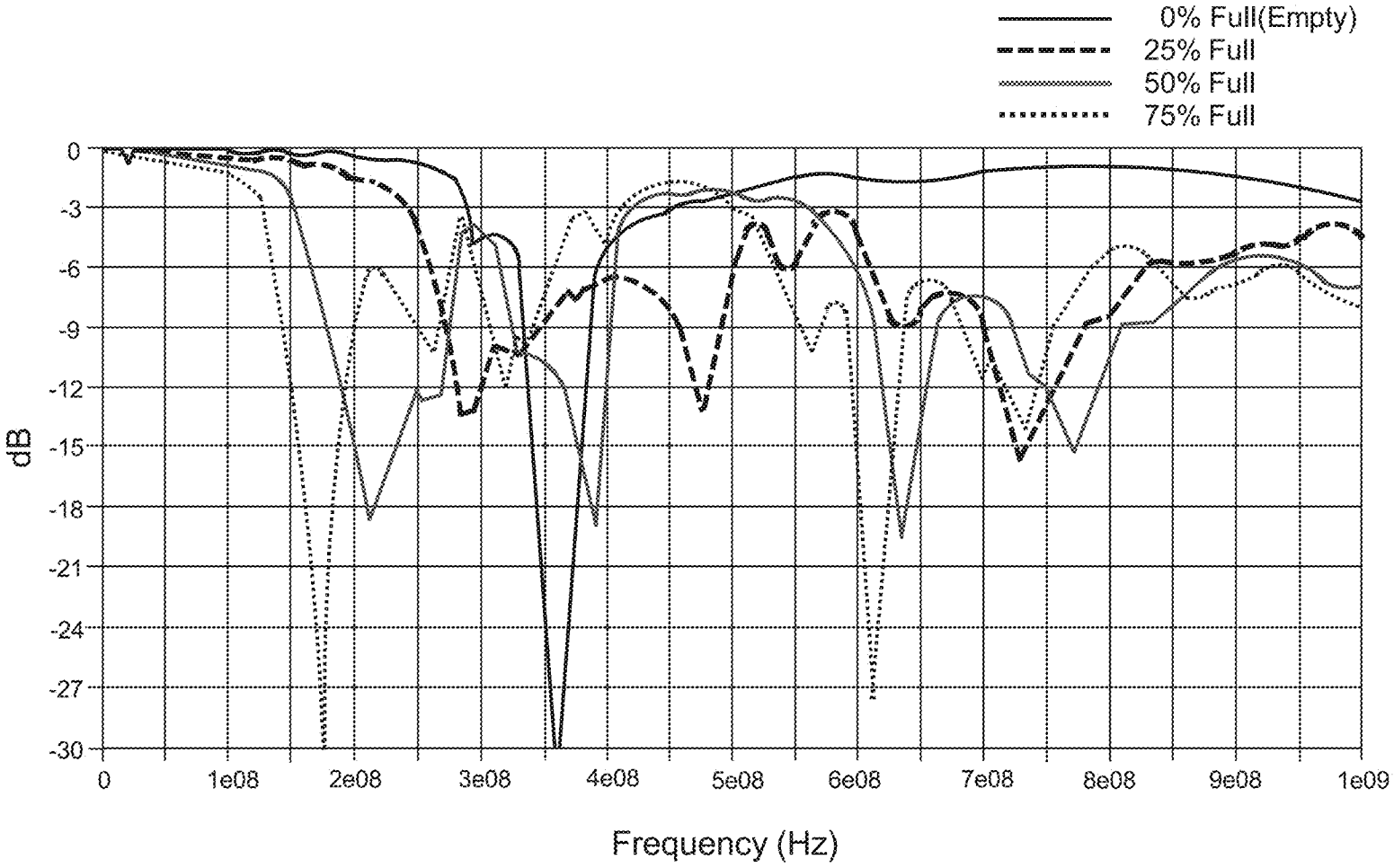
FIG. 8A illustrates the first return losses from FIGS. 7A through 7D for the first monopole antenna at each volume level (percent full)
Figure 8B:
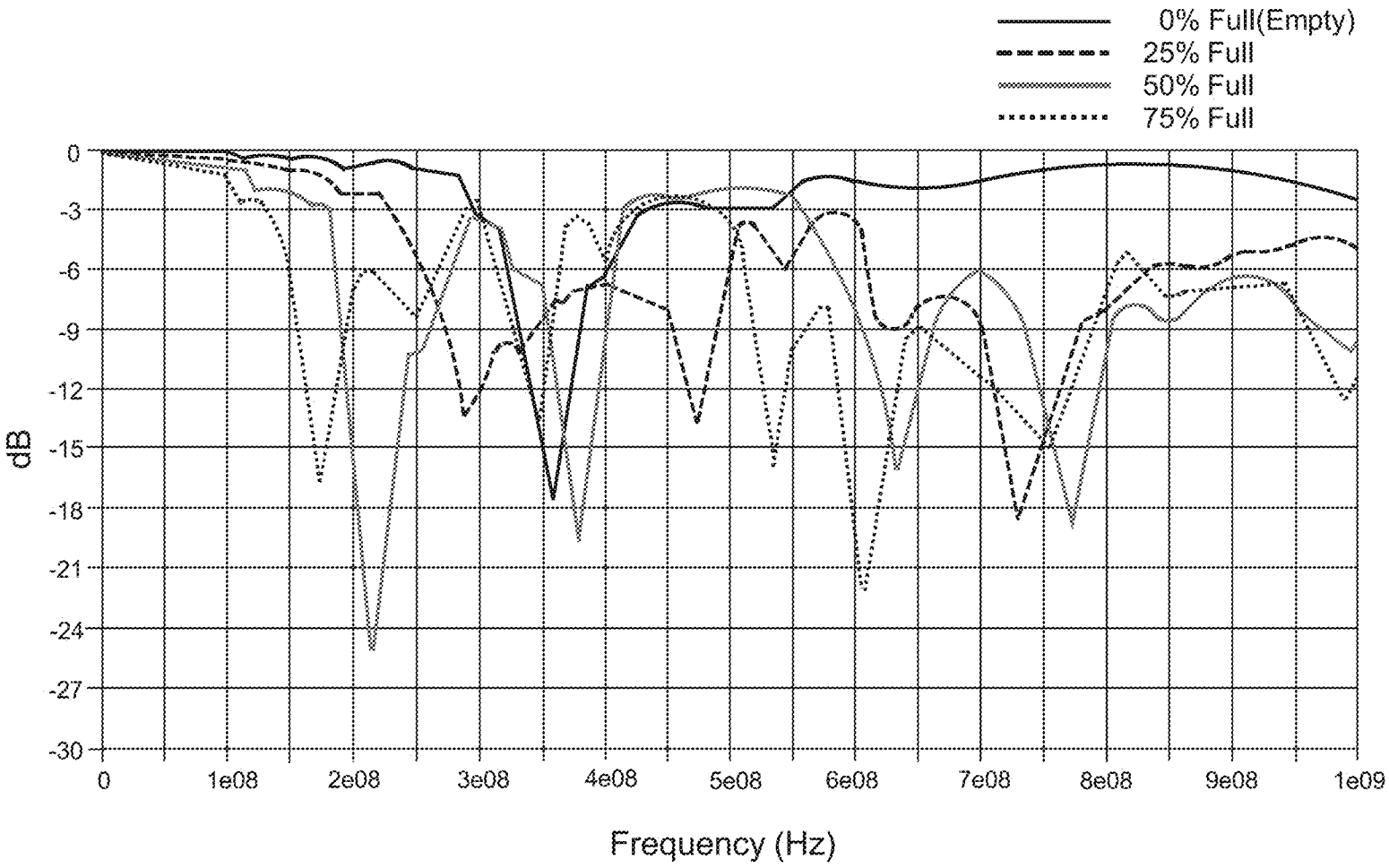
FIG. 8B illustrates the second return losses from FIGS. 7A through 7D for the second monopole antenna at each volume level (percent full).

FIG. 8A illustrates the first return losses for the first monopole antenna from FIGS. 7A through 7D at each volume level (percent full). FIG. 8B illustrates the second return losses for the second monopole antenna at each volume level (percent full). As shown in FIGS. 8A and 8B, a correlation exists between return loss and the level of the liquid in the container. As shown in FIGS. 8A and 8B, at a given test frequency (below about 180 MHz), the return loss decreases as the level of liquid increases.

Thus, in some embodiments, the radiofrequency circuit may provide signals indicative of the level of the volume of the liquid within the container based on the return loss of the first monopole antenna (and second monopole antenna if present). The processing circuity of the radiofrequency circuit may correlate the detected return loss at the test frequency (e.g., 150 MHz) with a predicted volume of liquid (e.g., by a lookup table, correlating formula, etc.).

The present inventors have discovered, however, that detecting a peak coupling between a pair of monopole antennas to detect the volume of the liquid in the container (for example as described above with reference to FIG. 2) provides various benefits compared with detecting a return loss of one or more of the monopole antennas (for example as described above with reference to FIG. 1). For instance, coupling has been discovered to generally have a single minimum value at lower frequencies (e.g., under 1 GHz in this example) that correlates well with the volume of liquid. In contrast, as shown in FIGS. 8A and 8B, the return loss does not exhibit such a relationship with the level of the volume of the liquid. Additionally, coupling may be less prone to undesirable interference than return loss of an individual monopole antenna. Thus, using coupling may generally be more robust to electromagnetic interference or noise or the presence of nearby conductive objects. As discussed above, however, return loss can still be used to detect the level of the volume of the liquid in the container according to aspects of the present disclosure.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A liquid level sensor system comprising:

a container configured to hold a volume of a liquid;

a monopole antenna arranged proximate the volume of the liquid; and a radiofrequency circuit configured to apply a radio frequency signal to the monopole antenna and provide one or more signals indicative of a level of the volume of the liquid within the container based on a radio frequency characteristic of the monopole antenna;

an additional monopole antenna arranged parallel with the monopole antenna;

wherein the radiofrequency circuit is further configured to:

apply an additional radio frequency signal to the additional monopole antenna;

calculate a peak coupling frequency between the monopole antenna and additional monopole antenna; and determine the one or more signals indicative of the level of the volume of the liquid provided by the radiofrequency circuit based on the peak coupling frequency.

2. The liquid level sensor system of claim 1, wherein the monopole antenna is coupled to an outer surface of the container.

3. The liquid level sensor system of claim 1, wherein the monopole antenna is arranged less than 5 cm from the volume of the liquid.

4. The liquid level sensor system of claim 1, wherein the monopole antenna is outside of the volume of the liquid.

5. The liquid level sensor system of claim 1, wherein the additional monopole antenna is located opposite the monopole antenna with respect to the container.

6. The liquid level sensor system of claim 1, wherein the monopole antenna has a length that is about equal to a length of the additional monopole antenna.

7. The liquid level sensor system of claim 1, wherein the monopole antenna has a first length in a first direction and the additional monopole antenna has a second length in the first direction, wherein a ratio of the first length to the second length ranges from about 0.5 to about 2.

8. The liquid level sensor system of claim 1, wherein the radiofrequency circuit is configured to apply an additional radio frequency signal to the additional monopole antenna.

9. The liquid level sensor system of claim 8, wherein the radiofrequency circuit is configured to calculate a coupling between the monopole antenna and additional monopole antenna, and determine the one or more signals indicative of the level of the volume of the liquid in the container based on the coupling.

10. The liquid level sensor system of claim 8, wherein the radiofrequency circuit is configured to calculate a peak coupling value between the monopole antenna and additional monopole antenna at a test frequency, and wherein the one or more signals indicative of the level of the volume of the liquid are positively correlated with the coupling at the test frequency.

11. The liquid level sensor system of claim 1, wherein the radiofrequency circuit is configured to calculate a return loss of the radio frequency signal, and wherein the one or more signals indicative of the level of the volume of the liquid within the container are based on the return loss.

12. The liquid level sensor system of claim 1, wherein the container comprises plastic.

13. The liquid level sensor of claim 1, wherein the monopole antenna is elongated in a direction that forms an angle with a vertical direction, the angle ranging from 0 degrees to about 70 degrees.

14. A method for sensing a level of a volume of a liquid in a container, the method comprising:

applying a first radio frequency signal from a radio frequency circuit to a first monopole antenna arranged proximate the volume of the liquid;

applying a second radio frequency signal from the radio frequency circuit to a second monopole antenna arranged proximate the volume of the liquid;

providing one or more signals indicative of the level of the volume of the liquid within the container based on a coupling between the first monopole antenna and the second monopole antenna; and determining a peak coupling value between the first monopole antenna and the second monopole antenna at a test frequency, wherein the one or more signals indicative of the level of the volume of the liquid are positively correlated with the coupling at the test frequency.

* * * * *